US006152312A

United States Patent [19]

Nava et al.

[11] Patent Number: 6,152,312

[45] **Date of Patent: *Nov. 28, 2000**

[54] SUSPENDING SYSTEM FOR VARIOUS TYPES OF HANGING SUPPORTS, IN PARTICULAR DESIGNED TO FIT WARDROBES

[75] Inventors: Paolo Nava, Lissone; Carlo Ballabio, Cabiate, both of Italy

[73] Assignee: Ezio Terragni, Lentate Sul Seveso, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/859,927

[22] Filed: May 21, 1997

[30] Foreign Application Priority Data

May 21, 1996 [IT] Italy ..... MI96A1014

[51] Int. Cl.[7] ..... A47F 5/08

[52] U.S. Cl. ..... 211/94.01; 211/99

[58] Field of Search ..... 211/88, 89, 113, 211/162, 99, 100, 94.07; 248/214, 307, 322, 244

[56] References Cited

U.S. PATENT DOCUMENTS

| | | | |
|---|---|---|---|
| D. 280,785 | 10/1985 | Benedict | D6/324 |
| D. 298,591 | 11/1988 | Arner et al. | D6/315 |
| 1,982,972 | 12/1934 | Roosendael | 211/99 |
| 2,787,435 | 4/1957 | Shields | 248/307 |
| 3,035,673 | 4/1962 | Schenkler | 211/94.01 X |
| 3,954,182 | 5/1976 | McEvers | 211/94 |
| 4,215,840 | 8/1980 | Babberl | 248/214 X |
| 4,334,363 | 6/1982 | Veith | 104/162 |
| 4,771,897 | 9/1988 | Ho | 211/13 |
| 4,771,899 | 9/1988 | Benedict et al. | 211/60.1 |
| 5,148,925 | 9/1992 | Althoff et al. | 211/94.01 X |
| 5,165,555 | 11/1992 | Anatalio | 211/105.1 X |
| 5,193,695 | 3/1993 | Mann | 211/100 X |
| 5,392,934 | 2/1995 | Fox | 211/94.01 |
| 5,412,912 | 5/1995 | Alves | 211/94.01 X |
| 5,429,252 | 7/1995 | Liu | 211/94 |
| 5,474,187 | 12/1995 | Taylor et al. | 211/1.56 |
| 5,740,927 | 4/1998 | Yemeni | 211/94.01 X |

*Primary Examiner*—Daniel P. Stodola
*Assistant Examiner*—Erica B. Harris
*Attorney, Agent, or Firm*—Oblon, Spivak, McClelland, Maier & Neustadt, P.C.

[57] ABSTRACT

A suspending system for various kinds of hanging supports includes a section bar suitable for removably receiving the hanging supports. The section bar cooperates with a device which keeps the section bar fastened to/hanging from a carrier. The hanging supports can include, for example, tie carrier hooks, container trays, and skirt and/or trousers carrier elements.

1 Claim, 6 Drawing Sheets

10
11
13
14
15
16
17
20
21
24
25
26
29
32
33
34
35

31
36
37
38
39
40
41
42
43
44
45
46

SUSPENDING SYSTEM FOR VARIOUS TYPES OF HANGING SUPPORTS, IN PARTICULAR DESIGNED TO FIT WARDROBES

BACKGROUND OF THE INVENTION

1. Field of the Invention

The present invention relates to a hanging system for supporting various kinds of support means, for example tie carrier hooks, skirt and trousers carrier elements, container trays, cloth carriers, etc.

2. Discussion of the Background

It is well-known that the problem of storing various types of articles, such as, for example, ties, belts, foulards, bunches of keys, and also trousers and skirts, tidily and with ease of to access, occupying the minimal room, for example inside a wardrobe room, is an increasingly felt need.

In this regard, fitting wardrobes and wardrobe cabinets with various kinds of individual supporting/carrier elements, each of which has a well precise purpose, is known.

At present, no universal systems exist on the market which are capable of combining in an extremely rational way, different carrier elements designed to receive neatly, and with easy access, apparel accessories, and still other articles of different kinds, which are generally worn.

The general purpose of the present invention is therefore to provide a universal hanging system which meets the present requirements of having available, inside a wardrobe and/or wardrobe cabinet, or also simply wall mounted, a plurality of carrier means of different types, precisely designed to rationally receive the various articles as recited above.

This purpose is achieved by a system having the characteristics recited in the appended claims.

BRIEF DESCRIPTION OF THE DRAWINGS

The structural and functional characteristics of the invention and the advantages thereof over the prior art will be more clearly understood from an examination of the following disclosure, made by referring to the accompanying drawings, which display exemplifying embodiments of the same invention.

In the drawings.

DESCRIPTION OF PREFERRED EMBODIMENTS

Figure 1:
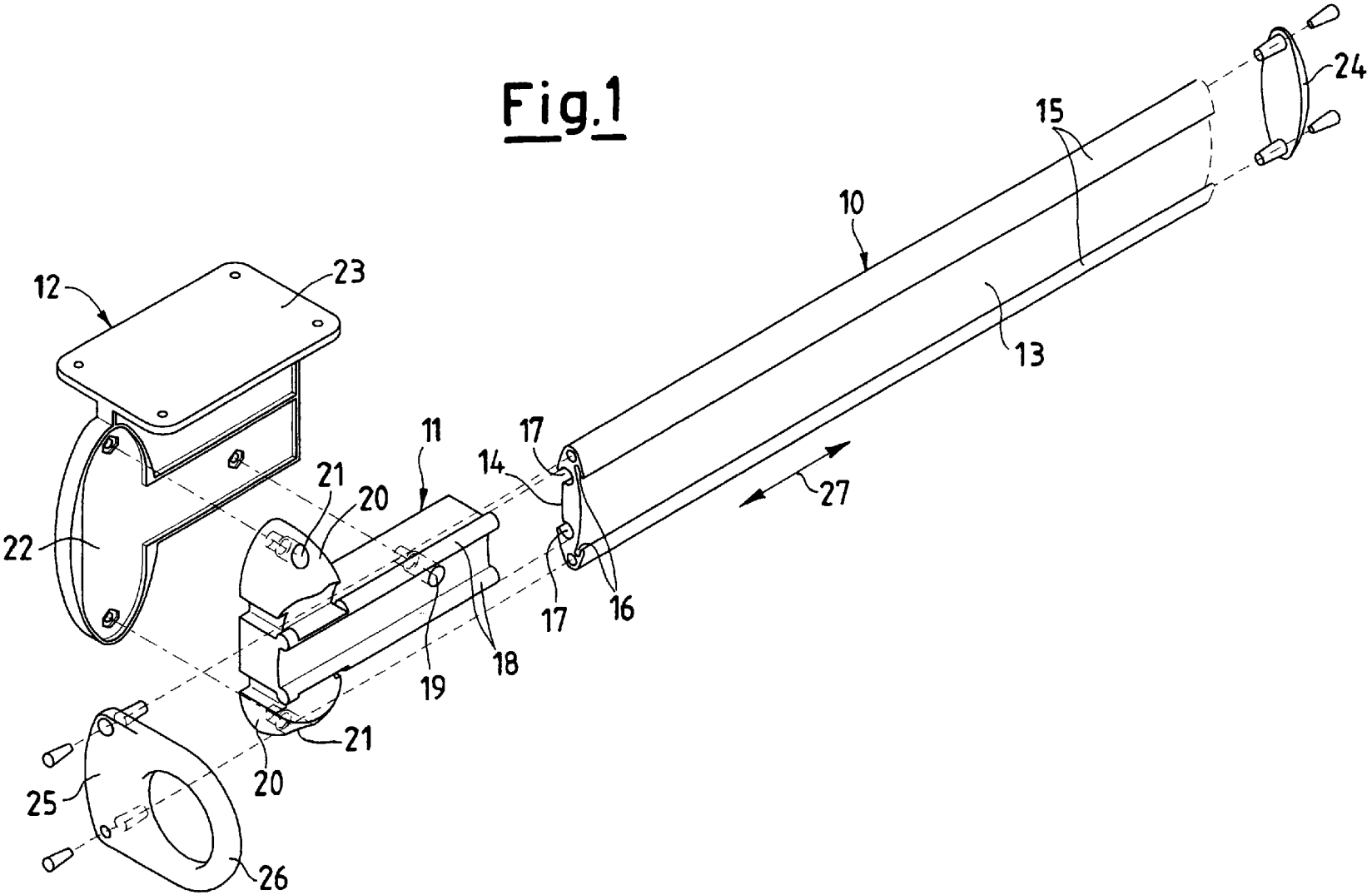
FIG. 1 shows a perspective, exploded view illustrating the support suspending system according to the invention.
Figure 2:
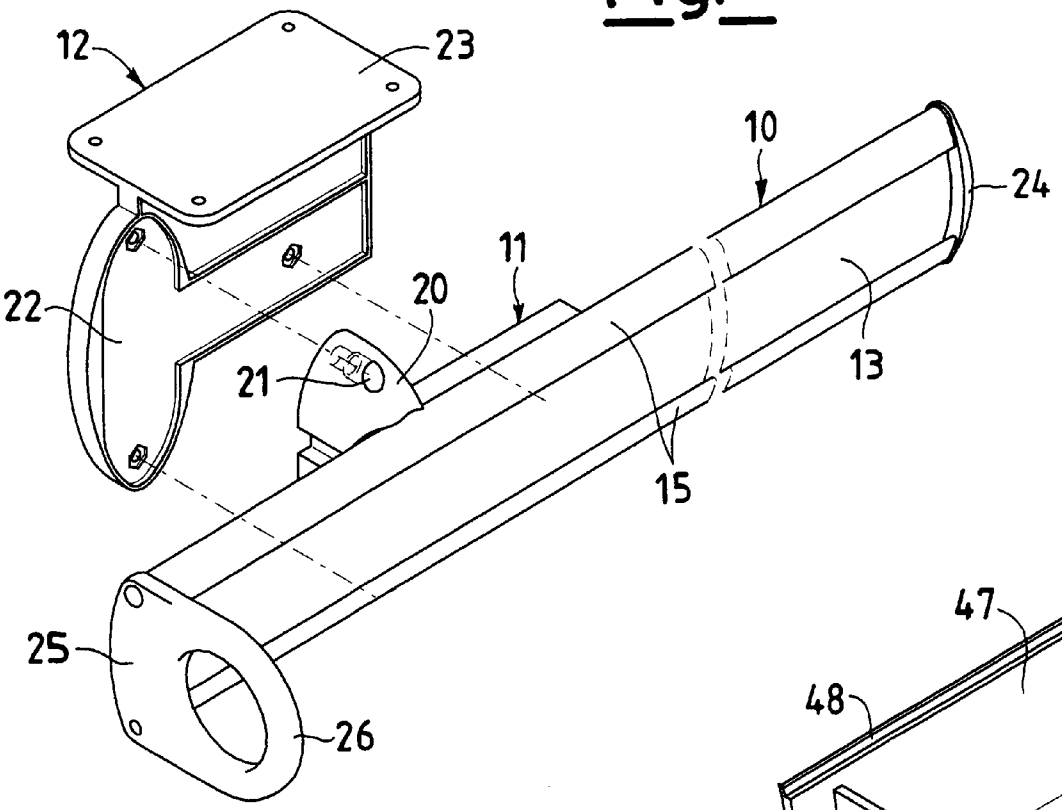
FIG. 2 shows a perspective view of the support suspending system of the invention, in a partially assembled condition.

Referring to FIGS. 1 and 2 of the accompanying drawings, the hanging support suspending system according to the present invention, in a possible embodiment thereof, is structurally formed by three main components, i.e.: a section bar 10, a fastener 11 and a bracket 12.

The section bar 10 comprises a front portion 13 suitable for receiving, as discussed hereafter, various kinds of hanging support elements, and a rear portion 14 suitable for being slidingly assembled on the fastener 11.

For that purpose, the front portion 13 is provided with a pair of mutually opposite edges 15 which define seats 16 suitable for freely removably receiving said support carrier means of various kinds, and the rear portion 14 is provided with two channel-like grooves 17 suitable for being assembled, in a freely and sliding manner, on complementary guides 18 provided on the fastener 11.

As one can clearly see from FIGS. 1 and 2 of accompanying drawings, said fastener 11 is suitable for being mounted and fastened by screws to the carrier bracket 12.

For that purpose, the fastener 11 is provided, through its elongated body, with a through-bore 19 and, through two flanges 20, with respective through-bores 21 suitable for allowing fastening screws to run therethrough.

The fastener 11 is housed and fastened inside a complementary seat 22 of the bracket 12, and is furthermore provided with a fastening plate 23, for example, to fasten it onto a shelf of a furniture piece (not displayed).

The section bar 10 is closed at its rear and front sides, respectively by two caps 24, 25, which also act as stroke ends, with the front cap 25 being given the shape of a ring-like handle 26 in order to drive the same section bar 10 to slide according to the directions of arrow 27.

The support means suspending system according to the present invention, instead of being fastened to an overlying shelf by using the bracket 12, can also be directly mounted onto the shoulder of a furniture piece, or it can be wall mounted, by using only the fastener 11, which is fastened by screws onto the same shoulder. Of course, in this case, the bracket 12 is no longer necessary.

Figure 3:
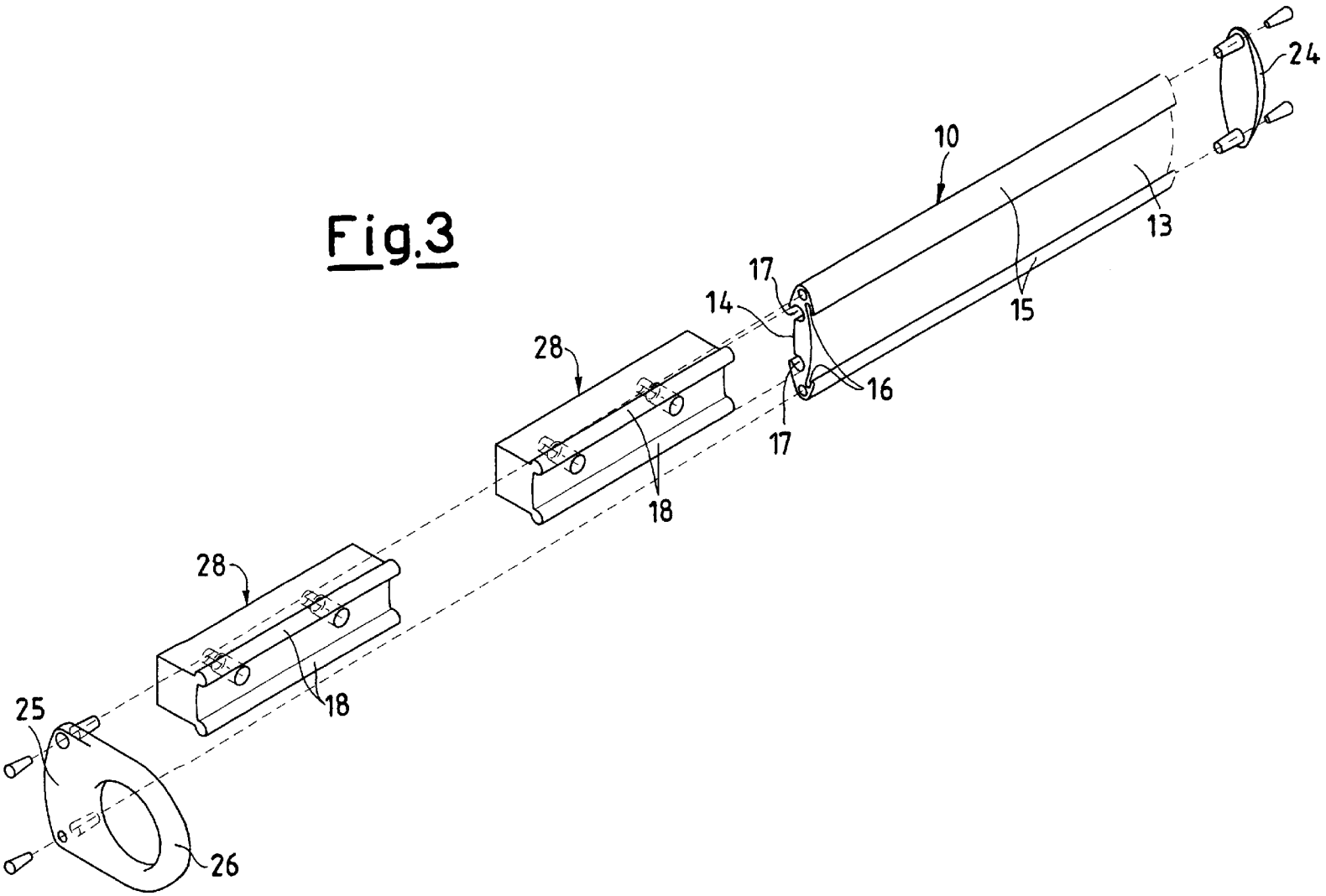
FIG. 3 displays a different embodiment of the support suspending system of FIGS. 1, 2.

According to the embodiment displayed in FIG. 3, the simplest one which can be thought of, the section bar 10 is fastened, by means of two end fasteners 28, to the shoulder of a furniture piece, or to a wall.

Figure 4:
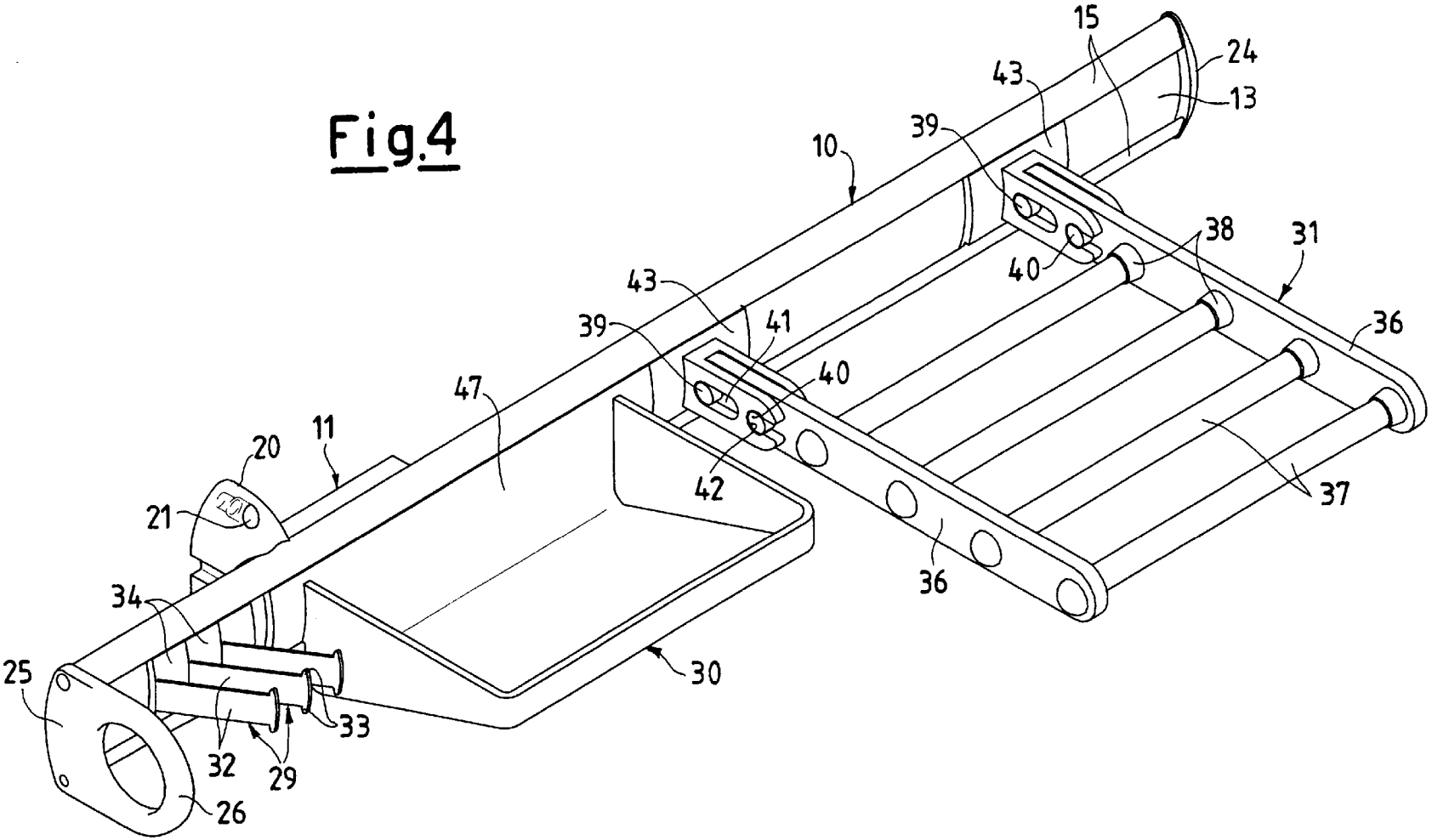
FIG. 4 is a perspective view illustrating the support suspending system of the present invention shown in FIGS. 1–3, bearing several types of carrier elements.

FIG. 4 displays an example of a suspending system for hanging support means realized according to the present invention, in which the section bar 10 bears a plurality of tie carrier hooks and/or belt carrier hooks 29, a carrier tray 30, and a carrier element for supporting skirts and/or trousers 31. Of course, other support means which are different from those shown for merely exemplifying, non-limitative purposes can also be used.

Figures 5, 6:
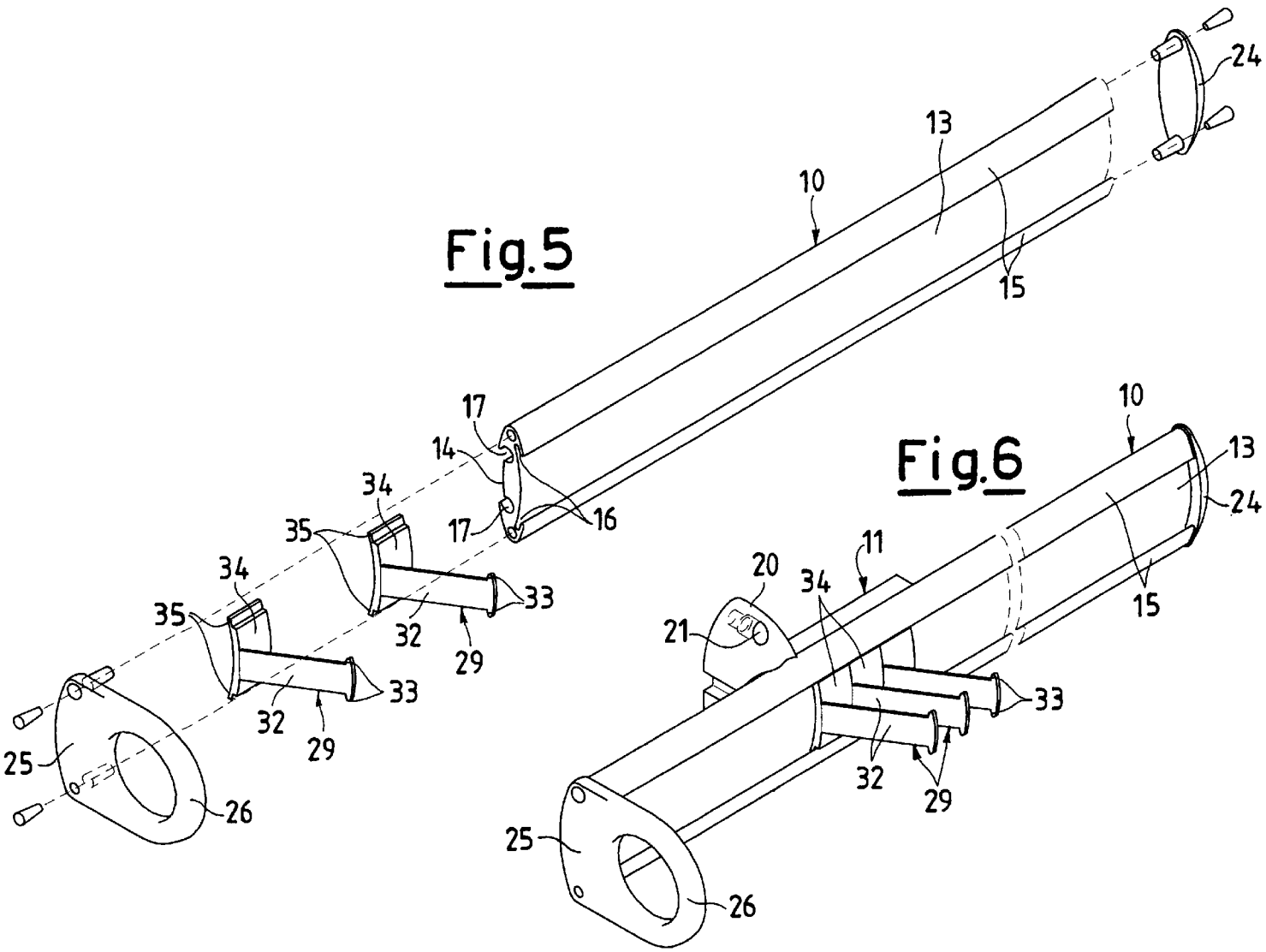
FIG. 5 is an exploded perspective view illustrating the support suspending system of the present invention bearing tie carrier hooks and/or belt carrier hooks.
FIG. 6 is a view of the system of FIG. 5, in its assembled condition.

As it will be clearly seen from the details of FIGS. 5, 6, said hooks 29 are constituted by an arm 32, ending, at an end, with two mutually opposite retainer teeth 33, and at its opposite end, with a flange 34 provided with mutually opposite guides 35 suitable for being freely and slidingly engaged inside the corresponding seats 16 of the section bar 10.

Figures 7, 8, 9:
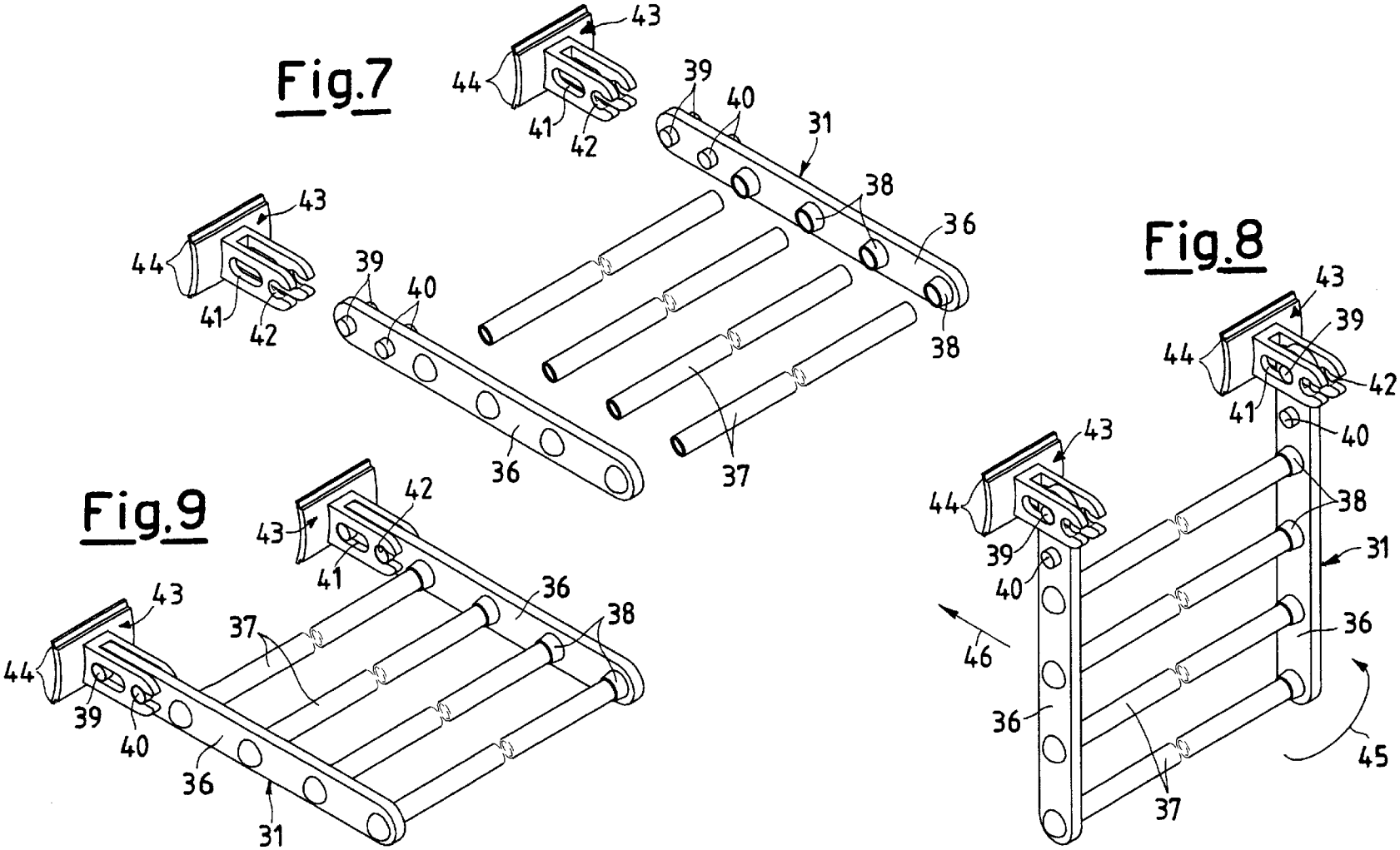
FIG. 7 is an exploded perspective view illustrating the carrier element for supporting skirts and/or trousers assembled in the system of FIG. 4.
FIG. 8 is a view of the assembled carrier element of FIG. 7 in its lowered position.
FIG. 9 shows a view of the carrier element of FIG. 8, in its lifted position.

Referring to FIGS. 7, 9, the support element 31 is structurally formed by two mutually opposite longitudinal bars 36, mutually connected by transversal rungs 37 entered inside seats 38 purposely provided along the length of the rods.

At an end, each of said rods 36 is provided with two pairs of mutually opposite pegs 39, 40, suitable for being engaged respectively inside mutually opposite slots 41 and seats 42 of a support flange 43. Said flange 43 is provided with mutually opposite guides 44 also suitable for position preferring slidingly inside the seats 16 of the section bar 10.

As clearly seen from FIGS. 7–9, the support element 31 can be tilted from its lowered position of FIG. 8 to the lifted position of FIG. 9, by being revolved in the direction of arrow 45, and then translated in the direction of arrow 46, so as to spring-wise engage the pegs 40 inside the seats 42 and stably lock in position said element 31 in its lifted, horizontal position shown in FIG. 4.

Figure 10:
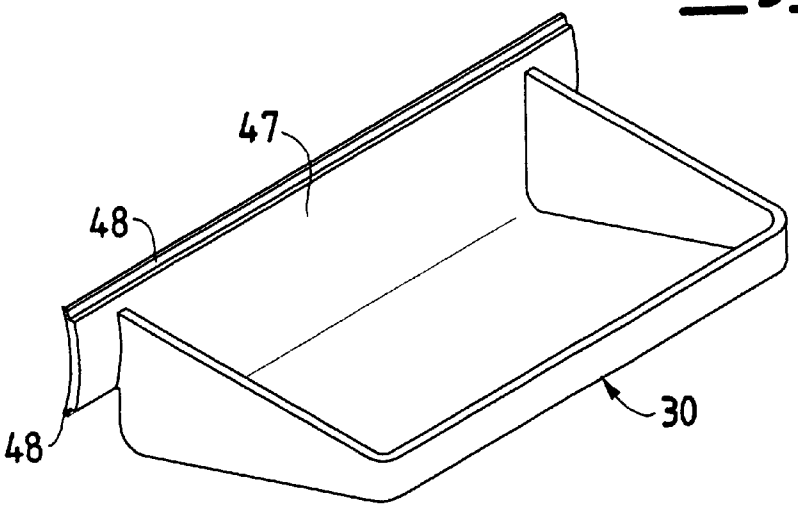
FIG. 10 is a perspective view of the carrier tray installed in the system of FIG. 4.

Referring to FIG. 10, the container tray 30 is provided with a rear wall 47 with mutually opposite guide means 48 also suitable for being engaged inside the section bar 10.

The purpose, recited in the preamble to the disclosure, of providing an extremely flexible system for tidily storing different articles inside a wardrobe, or a similar room, suitable for that purpose, is thus achieved.

What is claimed is:

1. A suspending system, which comprises:

at least one of a hanging support and a carrier;

a section bar slidably removably receiving said at least one of said support and said carrier;

a support bracket having a seat provided therein;

a mounting member slidably suspending said section bar therefrom and which comprises a single fastener fixed to said seat of said support bracket such that said section bar is slidable in said fastener, said section bar having a member limiting sliding movement of said section bar on said fastener;

wherein at least one of said support and said carrier comprises a carrier element for supporting clothing and which is movable between a lowered position and a raised position and wherein said carrier element comprises a pair of opposed longitudinal rods connected to each other by transverse rungs provided in seats mounted in said rods, wherein each of said rods has, at one end thereof, two pairs of mutually opposed pegs respectively engaging opposed slots and seats of a supporting flange, said flange being provided with opposed guides slidingly engaging seats located on said section bar.

* * * * *